United States Patent [19]

Javeri

[11] 4,329,959

[45] May 18, 1982

[54] DWELL CIRCUITRY FOR AN IGNITION CONTROL SYSTEM

[75] Inventor: Rupin J. Javeri, Elk Grove Village, Ill.

[73] Assignee: Motorola, Inc., Schaumburg, Ill.

[21] Appl. No.: 49,013

[22] Filed: Jun. 15, 1979

[51] Int. Cl.[3] ..... F02P 5/04

[52] U.S. Cl. ..... 123/416; 123/609; 235/92 CT

[58] Field of Search ..... 123/117 D, 117 R, 148 E; 235/92 FQ, 92 T, 92 CT; 364/770

[56] References Cited

U.S. PATENT DOCUMENTS

| | | | |
|---|---|---|---|
| 3,532,866 | 10/1970 | Schaefer et al. | 364/770 |
| 3,738,339 | 6/1973 | Huntzinger et al. | 123/117 R |
| 3,908,616 | 9/1975 | Sasayama | 123/117 R |
| 3,921,610 | 11/1975 | Hartig | 123/117 D |
| 4,018,202 | 4/1977 | Gartner | 123/148 E |
| 4,051,822 | 10/1977 | Yoshida | 123/117 D |
| 4,052,967 | 10/1977 | Colling et al. | 123/117 D |
| 4,081,995 | 4/1978 | Griffith et al. | 123/117 D |
| 4,104,997 | 8/1978 | Padgitt | 123/117 R |
| 4,168,682 | 9/1979 | Gartner et al. | 123/117 D |
| 4,174,688 | 11/1979 | Hönig et al. | 123/117 D |
| 4,196,705 | 4/1980 | Hattori et al. | 123/418 |
| 4,217,868 | 8/1980 | Gräther et al. | 123/416 |

*Primary Examiner*—Charles J. Myhre

*Assistant Examiner*—Andrew M. Dolinar

*Attorney, Agent, or Firm*—James W. Gillman; Phillip H. Melamed; James S. Pristelski

[57] ABSTRACT

Digital dwell circuitry for a spark and dwell ignition control system is disclosed. Maximum advance and reference sensors are utilized to produce pulse transitions which determine positions of maximum and minimum possible advance for spark ignition with respect to the position of the engine crankshaft. For each maximum advance sensor pulse transition a main counter starts a sequential running count of speed independent clock pulses wherein the maximum count obtained by the counter is related to engine crankshaft speed. The running and maximum counts of the main counter are utilized by dwell circuitry to determine the time prior to the next maximum advance pulse at which spark coil excitation should occur. The main counter running count also determines several inputs to a read only memory (ROM) circuit whose output controls a rate multiplier. The rate multiplier receives input clock signals, provides selective frequency division for these clock signals in accordance with the ROM output, and the output of the rate multiplier is coupled to an accumulator means whose accumulated count is utilized to determine the occurrence of spark ignition by terminating spark coil excitation.

11 Claims, 12 Drawing Figures

FIG. 11c
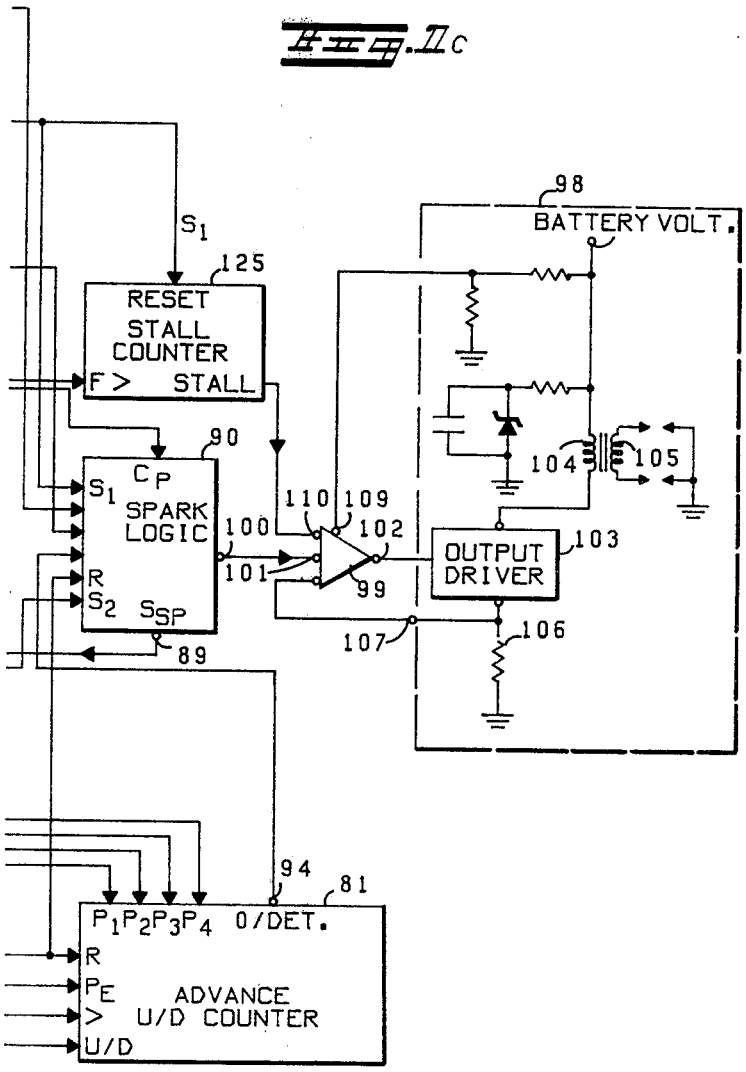
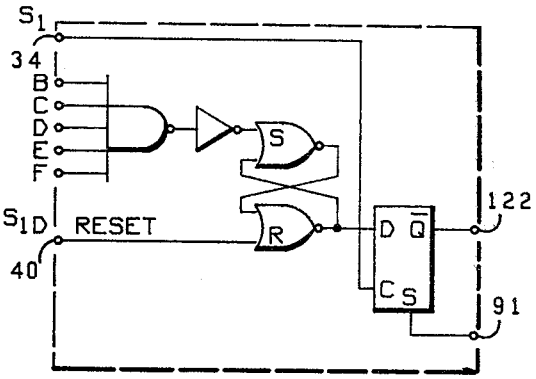
FIG. 6

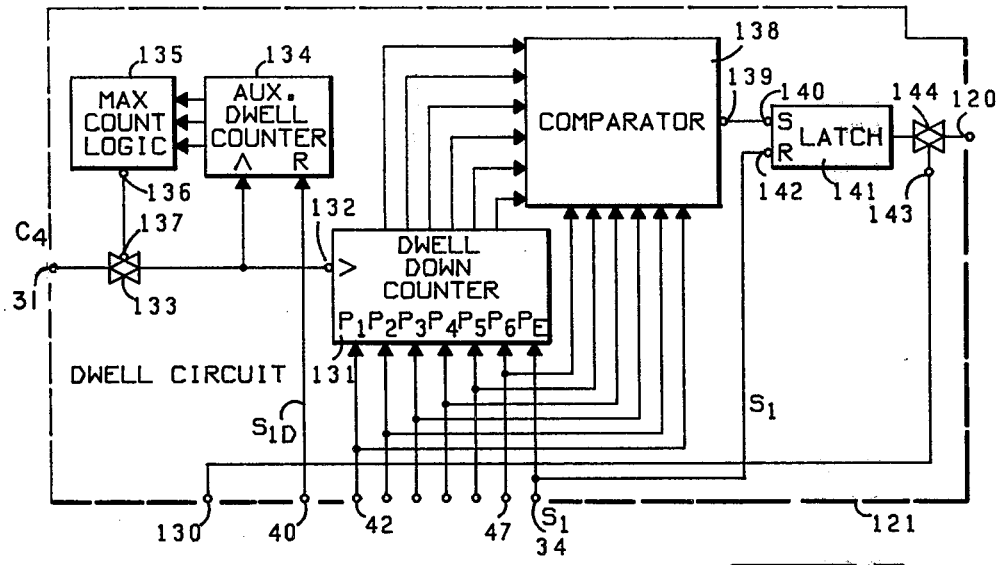
FIG. 2
FIG. 3
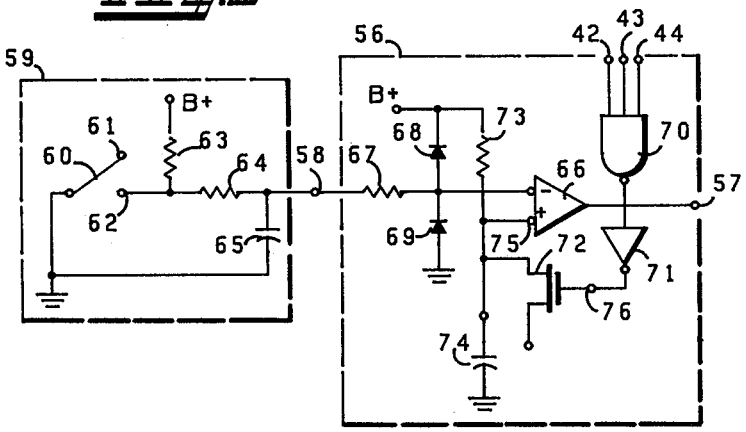
FIG. 5
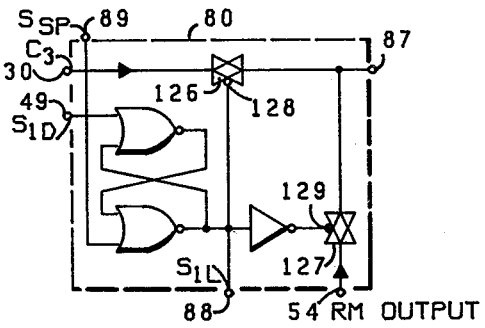
FIG. 9
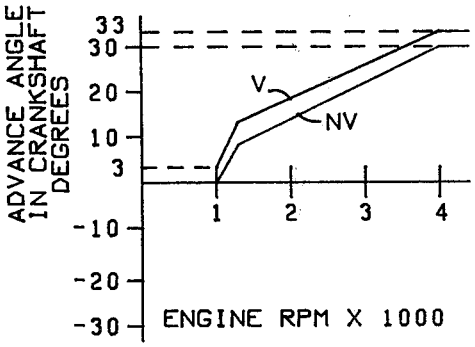

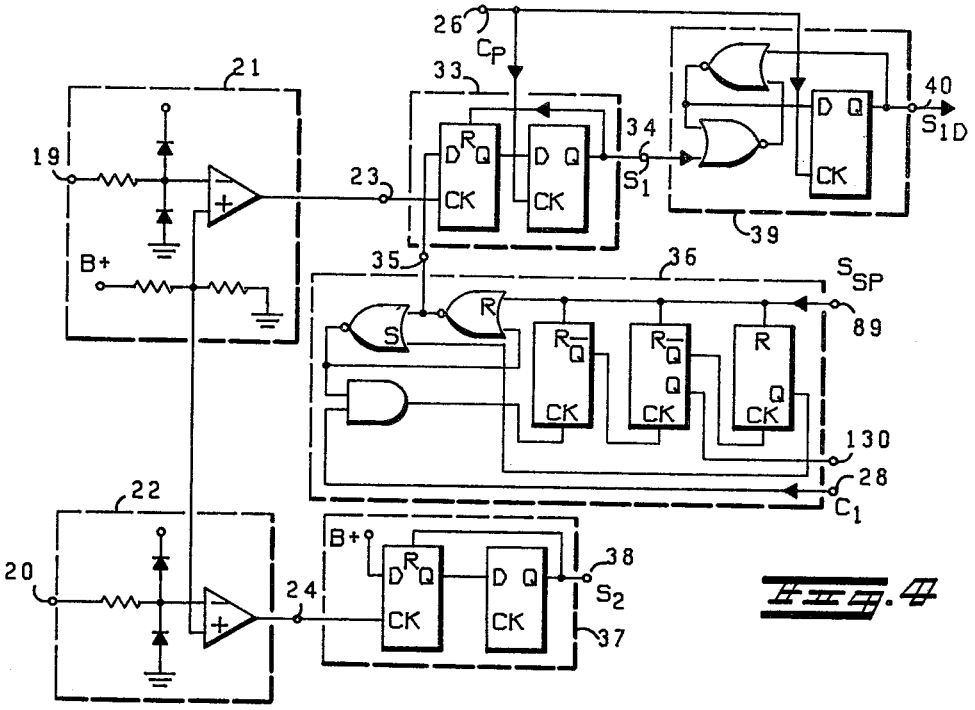
FIG. 4
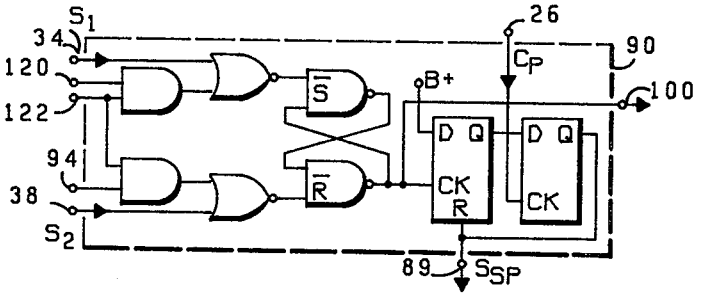
FIG. 7
FIG. 8
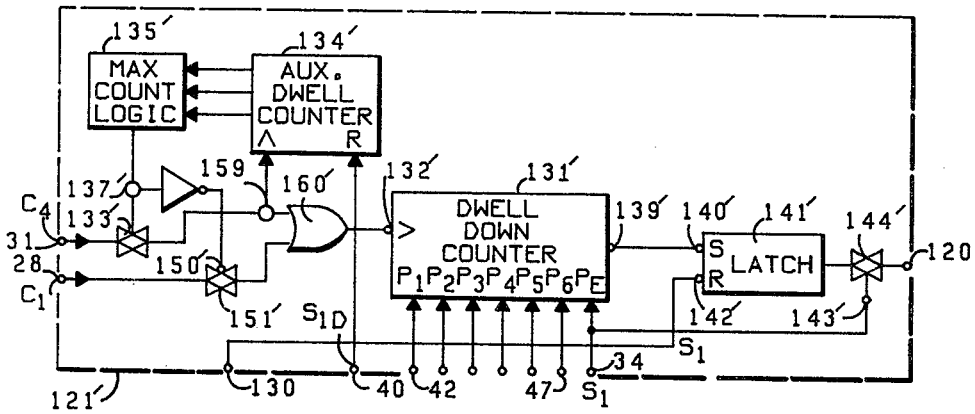

DWELL CIRCUITRY FOR AN IGNITION CONTROL SYSTEM

CROSS REFERENCE TO RELATED APPLICATIONS

The present invention is related to the inventions described and claimed in copending U.S. patent application Ser. No. 049,016, filed June 15, 1979, now U.S. Pat. No. 4,231,332 entitled "Spark and Dwell Ignition Control System Using Digital Circuitry" by Robert S. Wrathall; and described and claimed in copending U.S. patent application Ser. No. 049,014, filed June 15, 1979 entitled "Improved Digital Dwell Circuit" by Adelore Petrie. Both of the copending U.S. applications referred to above are assigned to the same assignee as the present invention.

BACKGROUND OF THE INVENTION

The present invention relates generally to the field of digital signal processing circuitry, and more particularly to the field of digital electronic dwell circuits used in ignition control systems which control spark and dwell occurrence.

In internal combustion engines the time occurrence at which a spark is produced to ignite a fuel and air mixture in a cylinder is a primary operational consideration. Similarly, producing an appropriate excitation signal (dwell) for an ignition coil immediately prior to the coil producing spark ignition is also a major design consideration. Mechanical spark control ignition systems have been found not to be reliable over long periods of time thus necessitating frequent readjustment of the mechanical controls. Thus electronic dwell and spark control ignition systems having greater reliability have been developed.

Electronic dwell circuits for ignition control systems are known and U.S. Pat. Nos. 3,908,616 and 4,018,202 illustrate digital circuits for determining a dwell control signal. While the circuits shown in these patents evidently produce accurate digital dwell control signals, generally they are not economically adaptable to operate in conjunction with digital spark timing circuits in which the spark timing is to be a function of engine speed and other additional engine variables. This is because generally prior art dwell circuits utilize circuitry which is separate from the spark timing calculation circuitry. Thus the dwell calculation is accomplished without the utilization of the majority of the spark calculation circuitry, thus increasing the cost of the total ignition control system.

Generally, prior art dwell circuits such as U.S. Pat. No. 4,018,202 utilize a complex and costly cam structure having an extremely large number of individual teeth projections in order to produce a series of high resolution crankshaft position pulses, typically one pulse being produced for every one degree of crankshaft rotation. The construction of these cams is costly and their utilization would tend to inhibit utilization of the same cam to produce other crankshaft position pulses which would occur at other than one degree increments of crankshaft rotation. Of course this deficiency can be overcome by utilizing additional cams and additional crankshaft position sensors, but then the cost of the ignition control system would be increased. While the one degree pulses can be electronically realized by dividing up large angular crankshaft pulses, this would also add to the cost of an ignition control system.

The one degree crankshaft position pulses produced by the prior art dwell circuits represent speed dependent crankshaft position pulses and enable the prior art circuits to readily calculate ignition dwell as a fixed number of degrees of crankshaft rotation. However these circuits have problems in realizing a constant dwell time, rather than constant dwell angle, which is desired from some engine operative conditions. Also prior dwell circuits such as U.S. Pat. No. 4,018,202 require complex feedback circuits having marginal stability.

Some dwell circuits such as those in U.S. Pat. No. 3,908,616 utilize speed independent pulses in order to calculate ignition dwell. While these circuits have eliminated the need for a multi-tooth crankshaft cam or its electronic equivalent for producing high resolution crankshaft position pulses, the disclosed circuit designs cannot produce large dwell angles which are required at high engine speeds. In addition, the dwell circuit in U.S. Pat. No. 3,908,616 contemplates adjusting count thresholds in order to adjust the dwell occurrence and/or contemplates adjusting the rate at which pulse counting takes place. In order to implement either of these two functions, relatively complex and costly control structures are required.

Typically, digital signal processing circuits which intend to implement the function of producing a pulse occurrence a predetermined time prior to the known occurrence of periodic signal pulse transitions having a variable occurrence rate have utilized circuit configurations corresponding to those shown in U.S. Pat. Nos. 3,908,616 or 4,018,202. Therefore they have suffered from the same deficiencies described above.

SUMMARY OF THE INVENTION

An object of the present invention is to provide an improved and simplified digital signal processing circuit which overcomes the aforementioned deficiencies and initiates a signal at a predetermined time prior to the occurrence of periodic variable rate signal transitions.

A more particular object of the present invention is to provide an improved digital dwell circuit for an ignition control system which overcomes the aforementioned deficiencies.

In one embodiment of the present invention, improved circuitry for receiving a signal comprising periodic pulse transitions and producing indicative signals commencing at predetermined times prior to the occurrence of the periodic pulse transistions is provided. The circuitry comprises: means for producing a periodic signal comprising periodic signal transitions occurring at a predetermined variable rate; means for receiving said periodic signal and for periodically developing a running count by counting pulses occurring at a predetermined rate, independent of said variable rate, between first and second predetermined time occurrences directly corresponding to the occurrence of sequential first and second pulse transitions of said periodic signal, and for providing at said second time ocurrences maximum running counts related to the time duration between said first and second pulse transitions; means for periodically receiving said maximum counts and effectively subtracting a predetermined number of counts therefrom to obtain a resultant subtracted count, said subtraction being completed at substantially said second time occurrences; and means for periodically using said resultant subtracted counts to initiate an indicative signal after said second time occurrences at which said maximum running count was created that resulted in said subtracted resultant count and at a predetermined time prior to the occurrence of the next of said pulse transitions of said periodic signal after said second time occurrences.

Essentially, an improved digital dwell circuit is provided which utilizes the circuitry recited in the preceding paragraph. The dwell circuit utilizes crankshaft position sensor means to create said periodic signal ($S_1$) having periodic pulse transitions. This corresponds to the periodic signal producing means providing signal transitions occurring at a variable (engine speed determined) rate. It should be noted that while the present specific embodiment illustrates utilizing crankshaft position sensor pulses directly as the periodic signal pulse transitions, the present invention also contemplates utilizing a spark occurrence signal (SSp) as the periodic signal having periodic signal pulse transitions which occur at a predetermined variable rate. A counter means essentially receives the periodic signal and at a first predetermined time occurrence ($t_1D$) directly related to a first pulse transition, the counter commences counting signal pulses ($C_1$) which occur at a speed independent rate. At second subsequent predetermined time occurrences ($t_1$) directly related to a second subsequent pulse transition a maximum running count is obtained which is related to the time duration that exists between the first and second pulse transitions. A subtraction means then effectively subtracts a predetermined number of pulses from this maximum pulse count, wherein the subtraction is essentially instantaneously accomplished at the second time occurrences. This subtracted count is then utilized to initiate a signal at a predetermined time prior to the next pulse transition of said periodic signal which occurs after the transition directly related second time occurrences $t_1$.

Preferably, the present invention contemplates utilizing a down counter to accomplish the subtraction, and a count comparator is utilized to compare the resultant subtracted count with the next subsequently created running count such that when the subtracted count equals the subsequent running count dwell will be initiated at a predetermined number of counts prior to the occurrence of the maximum running count. In this manner the present invention is capable of producing up to almost 100% dwell if necessary since the number of subtracted counts can be any arbitrarily large number and thus dwell can be initiated at any time after the second transition and before the next transition. It is contemplated that preferably the pulse transitions all have the same polarity. The present invention also readily enables initiating dwell at a fixed speed independent time prior to the pulse transitions of the periodic signal, since the initiation of dwell will occur at a time prior to a pulse transition equal to a predetermined number of the counts of the speed independent signal $C_1$. This is all accomplished without adjusting the rate at which pulse counting occurs and without adjusting the switching threshold of count comparator devices, since in the present invention the count comparator will have a fixed switching threshold corresponding to when the subtracted count precisely equals the subsequently obtained running count.

It should be noted that the dwell circuit of the present invention is contemplated as being utilized in an ignition dwell and spark control system in which the circuitry which produced the running count also is utilized to determine spark occurrence. This double utilization of the running count by both the dwell and spark timing circuits of an ignition control system reduces the cost of the ignition control system.

BRIEF DESCRIPTION OF THE DRAWINGS

For a more complete understanding of the invention, reference should be made to the drawings, in which:

FIG. 2 is a schematic diagram illustrating a typical configuration for a dwell circuit illustrated in FIG. 1;

FIG. 3 is a schematic diagram illustrating a typical configuration for a pulse width modulator circuit shown in FIG. 1;

FIG. 4 is a schematic diagram illustrating typical circuit configurations for several of the block components shown in FIG. 1;

FIG. 5 is a schematic diagram illustrating a typical configuration for a select decoder illustrated in FIG. 1;

FIG. 6 is a schematic diagram illustrating a typical configuration for a slow speed decoder shown in FIG. 1;

FIG. 7 is a schematic diagram illustrating a typical configuration for a spark logic circuit shown in FIG. 1;

FIG. 8 is a schematic diagram of another typical embodiment for a dwell circuit shown in FIG. 1;

FIG. 9 is a graph which shows the desired spark timing versus engine speed characteristic provided by the circuit in FIG. 1.

DESCRIPTION OF THE PREFERRED EMBODIMENTS

Figure 1A:
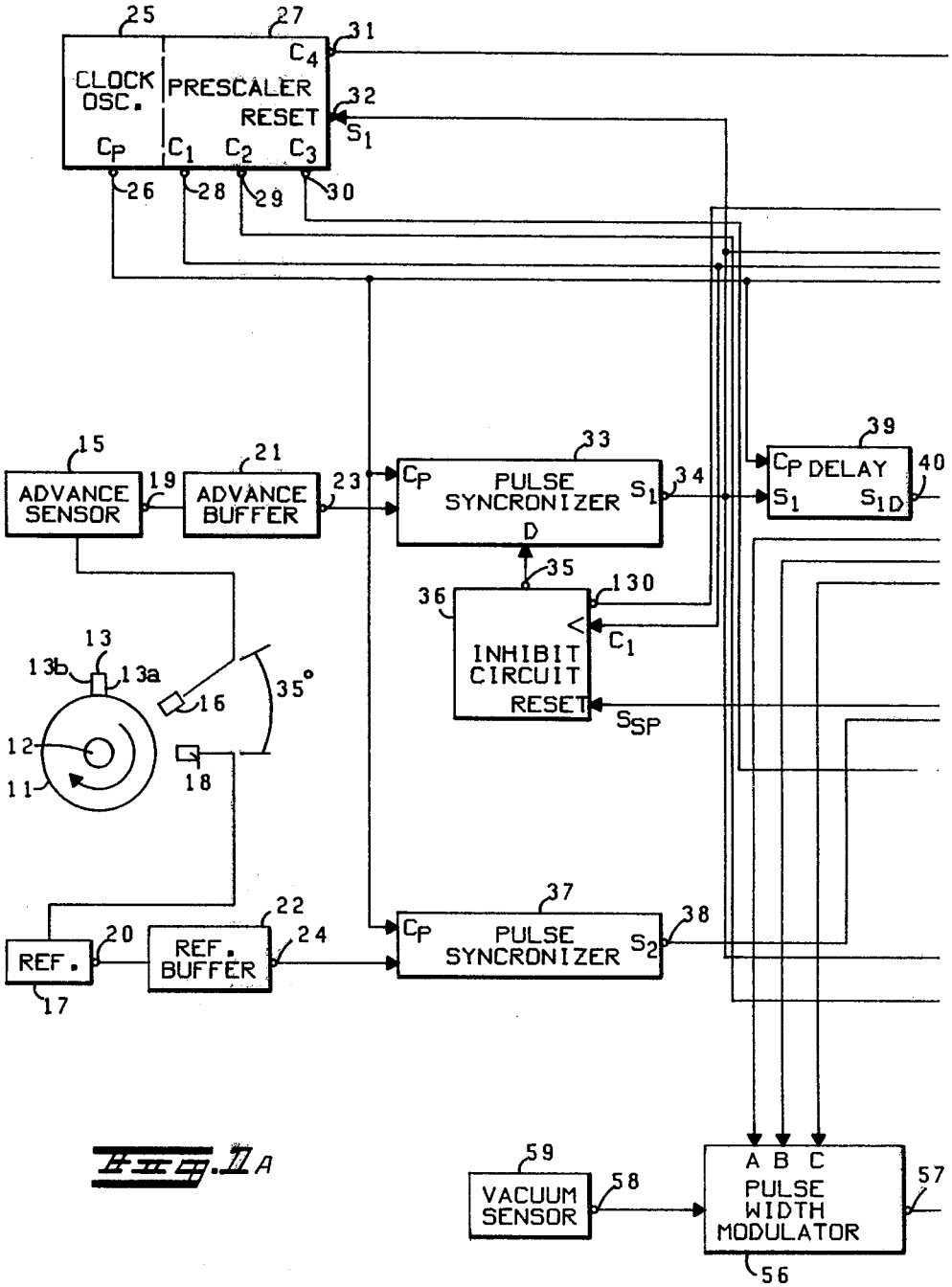
FIG. 1, comprising drawings 1A, 1B and 1C, is a combination block and schematic diagram illustrating an engine ignition control system for an internal combustion engine.
Figure 11B:
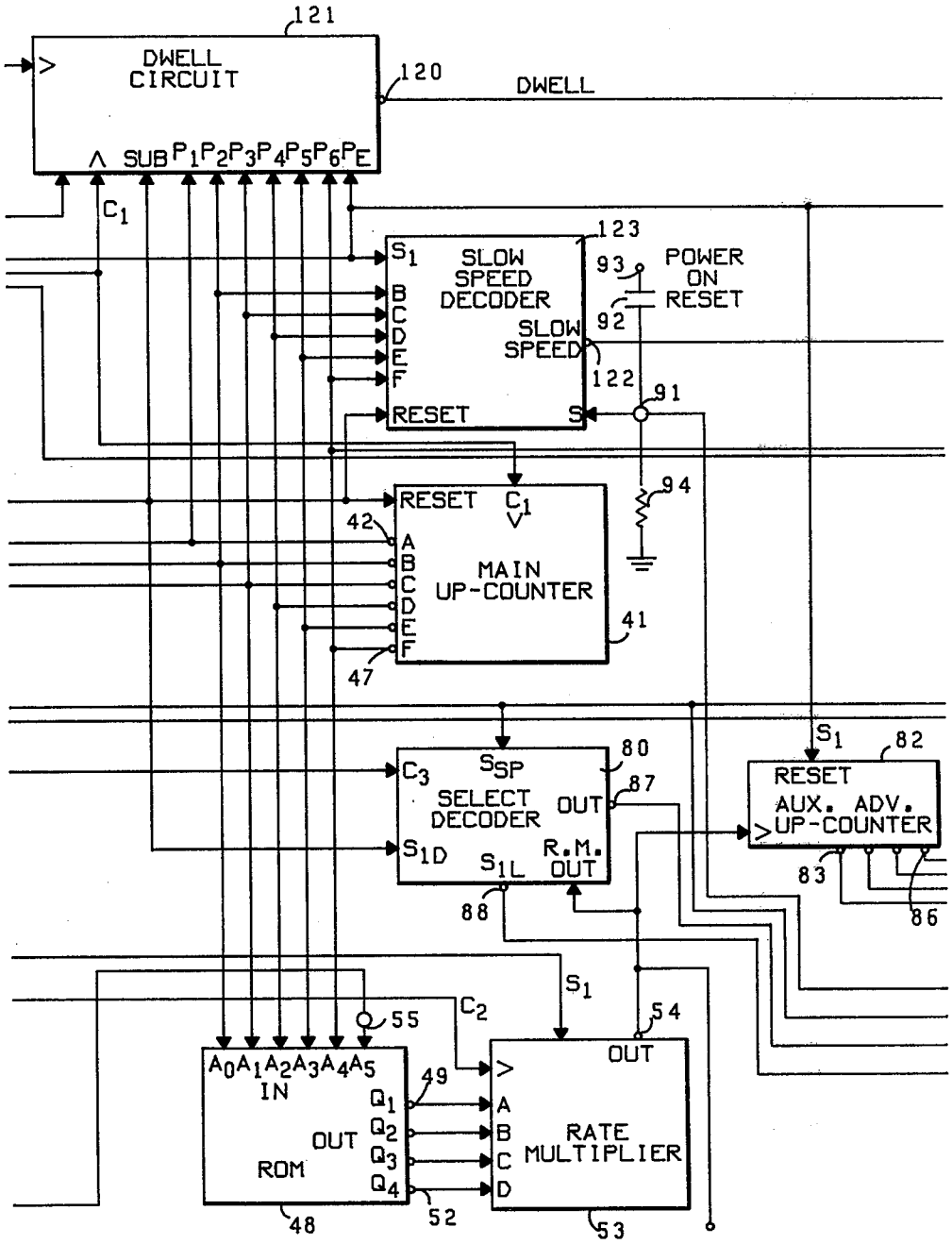

FIG. 1 illustrates an electronic ignition control system 10 for a two cylinder internal combustion engine (not shown). Essentially the control system 10 receives sensor input signals and develops control signals that determine the spark timing and dwell (coil excitation time) for a distributorless inductive ignition system. The term "distributorless" contemplates the fact that no rotating mechanical distributor will be utilized, and that instead sparks will be created in each of the two cylinders simultaneously but at different times with respect to the compression cycle of each cylinder. In other words, when a spark is generated for cylinder 1 at the proper time of its compression cycle, a spark will also be generated in cylinder 2 but this spark will occur during the exhaust cycle of cylinder two and therefore will not result in igniting a fuel mixture. Distributorless ignition systems are known and do not form an essential part of the present invention.

The control system 10 illustrated in FIG. 1 will now be described. For a better understanding of FIG. 1, drawings 1A, 1B and 1C should be arranged with drawing 1B located between drawings 1A and 1C.

The control system 10 includes a rotating cam 11 synchronously rotatable with a crankshaft of a two cylinder engine, the crankshaft being shown schematically as an axis of rotation 12. The cam 11 has a peripheral projection 13 spaced from the axis 12 and the cam 11 is contemplated as rotating in a clockwise direction.

An advance sensor 15 is contemplated as having a sensing probe 16 positioned at a fixed location with respect to the rotating cam 11, and a reference sensor 17 is contemplated as having a sensing probe 18 similarly positioned with the probes 16 and 18 being spaced apart by 35 degrees of angular rotation of the cam 11 (which corresponds to 35 degrees of engine crankshaft rotation). The probes 16 and 18 produce crankshaft angular position pulses as the projection 13 rotates by these probes with the produced position sensing pulses initially occurring in response to the passage of a leading edge 13*a* of the projection passing by the sensing probes and the position pulses terminating after a trailing edge 13*b* has passed by the probes 16 and 18. The advance sensors 15 and 17 receive input signals from their corresponding sensing probes and produce digital pulse outputs in correspondence thereto at output terminals 19 and 20, respectively.

It should be noted that the positioning of the sensing probes 16 and 18 and with respect to the rotating cam 11 and its projection 13 is not totally arbitrary and that it is contemplated that the probe 16 is positioned such that it defines the maximum possible advance (earliest possible spark ignition occurrence for a cylinder compression cycle) for the ignition system 10 while the probe 18 defines the minimum possible advance (generally corresponding to top dead center of cylinder position which is generally termed zero or reference advance). Thus the positioning of the probe 16 and 18 define the earliest and latest possible occurrences of spark ignition, respectively, for the ignition control system 10. The significance of this will be demonstrated subsequently.

Figure 10:
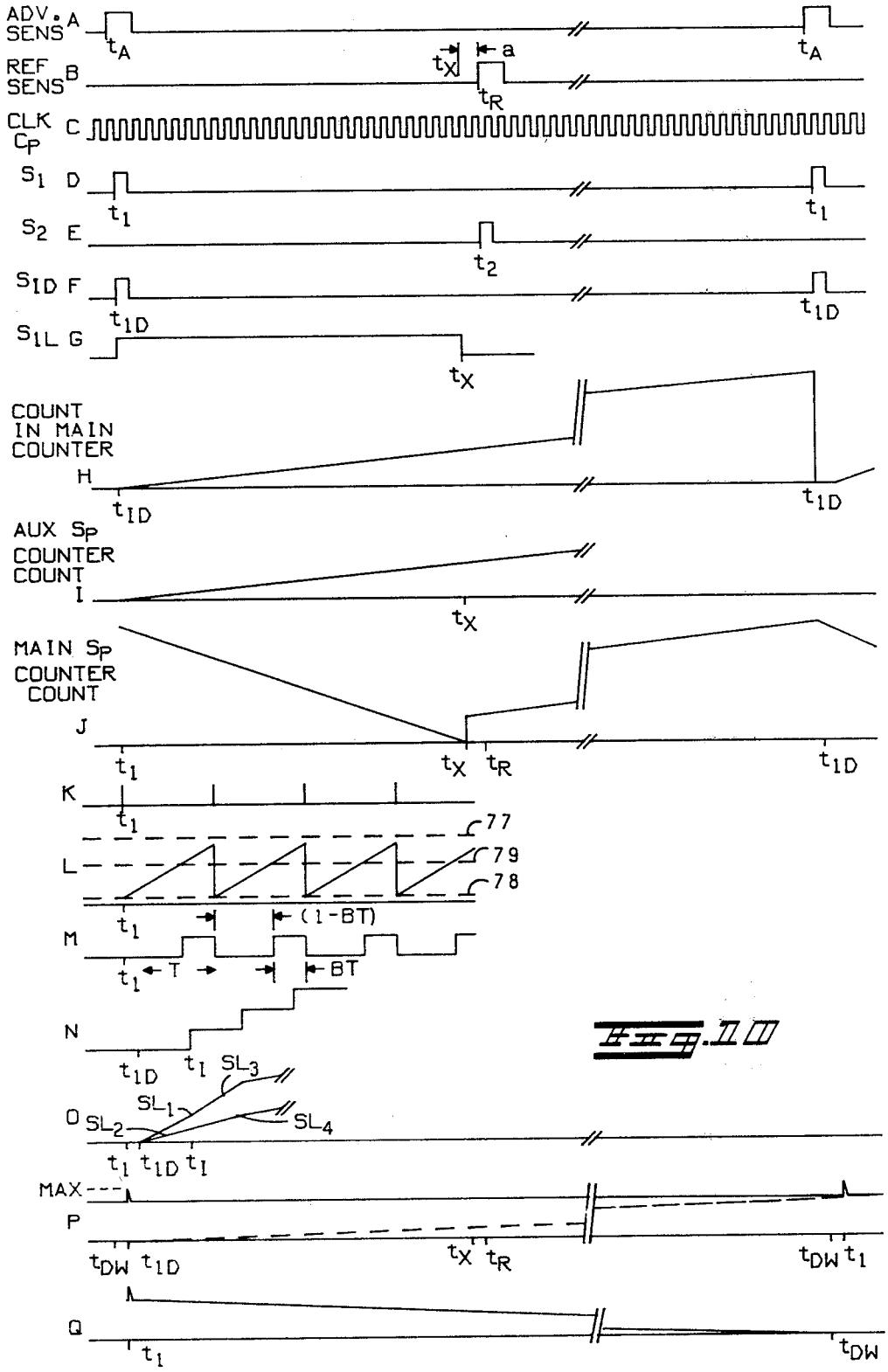
FIGS. 10A through 10Q are a series of graphs which illustrate electrical signals and pulse count accumulations as functions of time for the system shown in FIG. 1.

The advance and reference output terminals 19 and 20 are coupled as inputs to advance and reference buffers 21 and 22, respectively, which impedance isolate the sensors from subsequent circuitry and insure the production of precise, uniform magnitude corresponding digital pulses at output terminals 23 and 24, respectively. FIGS. 10A and 10B illustrate the sensing pulses produced at the terminals 23 and 24, respectively, and illustrate that these pulses occur periodically at times $t_A$ and $t_R$ corresponding to the passage of the leading edge 13*a* past the sensing probes 16 and 18. The time occurrences $t_A$ and $t_R$ of the pulses at the terminals 23 and 24 are utilized by the ignition control system 10 to determine spark timing and dwell, and the manner in which this is accomplished will now be discussed with reference to the circuit schematics in FIGS. 1 through 8 and the graphs in FIGS. 9 and 10A–Q. It should be noted that horizontal axis in FIGS. 10A–Q is time and that FIGS. 10A, 10B, 10D–10J and 10P and Q are drawn having the same time axis scale, while FIGS. 10C and 10K through 100 are drawn with a greatly expanded time scale.

The control system 10 includes a master clock oscillator 25 which produces clock timing pulses $C_P$ at an output terminal 26 wherein the frequency of the clock oscillator is preferably 149.25 KHz. The clock pulses $C_P$ are illustrated schematically in FIG. 10C on a greatly expanded horizontal time scale and are continuously produced by the oscillator 25 regardless of the angular position of the crankshaft of the engine. A prescaler 27 is shown as being integral with the clock oscillator 25 and producing output signals C1 through C4 at output terminals 28 through 31, respectively. The prescaler essentially comprises a series of counters which receive the clock signal $C_P$ and produce related lower frequency signals by essentially counting and thereby frequency dividing down the oscillator signal pulses $C_P$. Such prescalers are very well known and thus the construction details of the prescaler 27 will not be discussed. The C1 signal produced at the terminal 28 has an operative frequency of 1.16 KHz, C2 has a frequency of 9.33 KHz, the frequency of C3 is 49.75 KHz and the frequency of C4 is 74.6 KHz. All of the signals $C_P$ and $C_1$–$C_4$ have repetition rates independent of the speed of crankshaft rotation. The prescaler 27 has a reset terminal 32 which causes resetting of the counters internal to the prescaler 27. The signals developed by the clock oscillator 25 and prescaler 27 at the terminals 26 and 28 through 31 essentially determine the operation of the ignition control system 10 in conjunction with the pulses sensed by the advance and reference probes 16 and 18. The signals produced at the terminals 28 through 31 are essentially used in various counters included in the ignition control system 10 and therefore the provision for resetting the internal counters in the prescaler 27 via the reset terminal 32 is required to insure that counters receiving their inputs in accordance with the signals at the terminals 28 through 31 will be synchronized with the advance sensor signal $S_1$ described below.

A pulse synchronizer 33 receives an advance signal input from the terminal 23 and the clock pulse signal $C_P$ from the terminal 26. The pulse synchronizer produces a synchronized advance pulse $S_1$ at an output terminal 34. Essentially, the synchronizer 33 insures that a pulse $S_1$ is produced at the terminal 34 at a time $t_1$ which corresponds to the first clock pulse $C_P$ that occurs after the time $t_A$. In this manner the signal $S_1$ (shown in FIG. 10D) represents an advance pulse which is synchronized with the occurrence of the clock pulses $C_P$.

The pulse synchronizer 33 also receives an input at a terminal D from an output terminal 35 of an inhibit circuit 36. Essentially the inhibit circuit 36 produces a 4 millisecond delay pulse at the terminal 35 in response to the occurrence of spark ignition and this delay or inhibit signal at the terminal 35 prevents the pulse synchronizer from producing an output at the terminal 34 for 4 milliseconds after the occurrence of spark ignition. The reason for this is to quiet the output of the synchronizer 33 such that additional sparks will not be initiated by the synchronizer 33 until at least 4 milliseconds has elapsed since the last spark occurrence.

A pulse synchronizer 37 is similar to the synchronizer 33 and receives inputs from the reference sensor terminal 24 and the clock pulse terminal 26 and produces a synchronized reference pulse signal $S_2$ at an output terminal 38. The synchronizer 37 merely insures that a reference signal $S_2$ has an initial time occurrence which precisely corresponds to the occurrence of one of the clock pulses $C_P$. Since it is contemplated that the frequency of occurrence of the clock pulse $C_P$ is very high (higher than all other timing signals C1–C4), this synchronization results in substantially no loss in accuracy for the present system, due to delaying advance and reference timing by one clock pulse, but does insure that the reference pulse $S_2$, as well as the advance pulse $S_1$, will occur in synchronism with the clock pulse $C_P$. This insures synchronized timing for the control system 10. The reference signal $S_2$ is illustrated in FIG. 10E as comprising periodic pulses which occur at the times $t_2$. It should be remembered that the duration of time between the occurrence of the advance pulses $S_1$ at $t_1$ and the reference pulses $S_2$ at the times $t_2$ corresponds to 35 degrees of engine crankshaft rotation. Of course the actual time duration between $t_1$ and $t_2$ will vary directly as a function of engine speed.

A delay circuit 39 receives the signal $S_1$ along with the clock pulses CP and produces a delayed output signal $S_1D$ at an output terminal 40. Essentially, the delay circuit 39 receives the synchronized signal $S_1$, delays this signal by one full period of the clock pulse signal $C_p$ and produces this delayed signal $S_1D$ at the terminal 40. FIG. 10F illustrates this delay advance signal $S_1D$ which has a time occurrence at $t_1D$ that is one clock pulse period later than the time occurrence $t_1$. The reason for creating the delayed advance signal $S_1D$ is that in many cases the control system 10 will transfer accumulated counts at the times $t_1$ in response to the pulses $S_1$, and subsequently the accumulated counts are to be reset. Obviously the transference and resetting cannot occur simultaneously, thus the present system provides for delaying the resetting until after transference.

The ignition control system 10 essentially utilizes a main up-counter 41 to linearly count up C1 pulses occurring at the terminal 28 in between the occurrence of delayed advance signal pulses $S_1D$. This is accomplished by having the main up-counter 41 receive its counter input from the terminal 28 while its reset terminal is directly connected to the terminal 40. The counter 41 therefore periodically linearly accumulates a speed independent running count which has a maximum value directly related to engine speed since the counting occurs during the times $t_1D$ which occur every 360 degrees of crankshaft rotation.

FIG. 10H illustrates a waveform representative of the linearly incremented running count of the counter 41. It should be noted that individual counting steps have not been illustrated in FIG. 10H since these steps occur at the relatively high frequency of the signal $C_1$ produced by the prescaler 27. However, FIG. 10N does illustrate the count in the main counter 41 on a very expanded horizontal time scale, and this figure clearly illustrates the incremental nature of the accumulated count in the counter 41.

The accumulated count of counter 41 is produced at 6 output terminals 42 through 47 with terminal 42 corresponding to the least significant bit and terminal 47 corresponding to the most significant bit. Thus the main up-counter 41 represents a 6 bit binary counter. Such counters are well known and readily available. It should be noted that while the electronic ignition control system 10 utilizes the maximum accumulated count obtained by the counter 41 as an indication of engine speed, the ignition system 10 also utilizes each incremental count produced by the counter 41 at its output terminals 43 through 47 as control signal inputs to spark time occurrence circuitry within the system 10, and these incremental counts are utilized to produce a desired non-linear spark occurrence versus engine speed characteristic. The manner in which this is accomplished will now be discussed.

Each of the output terminals 43 through 47 of the main up-counter 41 are coupled as inputs to a read only memory (ROM) device 48 which has 4 output terminals 49 through 52 which are coupled as control signal inputs to a rate multiplier device 53. The rate multiplier 53 receives a continuous stream of input clock pulses C2 via a direct connection to the terminal 29 and produces a corresponding output pulse stream at an output terminal 54 in accordance with the control signals received from the terminals 49 through 52. The rate multiplier device 53 is set by the pulse $S_1$ which is received via a direct connection from the terminal 34, and this reinitiates the operation of the rate multiplier 53. The rate multiplier essentially functions as a controllable frequency divider which multiplies (actually divides) the frequency of the input pulse stream by predetermined integers which are determined by the control signals received from the ROM. Rate multipliers are well known and are readily available.

Essentially, the pulse stream produced at the output terminal 54 is subsequently accumulated in an accumulator means which develops a count related to the number of pulses produced at the terminal 54. The exact structure of the accumulator means which accomplishes this will be described subsequently. This total accumulated count, which occurs between the pulses $S_1$, is then subsequently utilized by the ignition control system 10 to determine the occurrence of spark ignition. The above described spark timing technique of utilizing a rate multiplier which is controlled by a read only memory circuit that receives incrementally controlled inputs related to engine speed (it should be remembered that in the present case the ROM inputs are the counts of the up-counter 41 which are related to engine speed) is essentially described in copending U.S. patent application Ser. No. 779,974, filed Mar. 22, 1977, now U.S. Pat. No. 4,168,682, and assigned to the same assignee as the present invention.

Essentially the ROM 48 functions as a table look-up device which produces different control signals at the terminals 49 through 52 that control the frequency multiplication (division) provided by the rate multiplier 53. The end result is that the output pulse count produced at the terminal 54 is a non-linear function of engine speed such that a desired spark ignition occurrence versus engine speed characteristic can be obtained. The accumulator means effectively integrates or accumulates the pulse count at the terminal 54 and determines, between $S_1$ pulses, a maximum pulse count non-linearly related to engine speed. This maximum pulse count is then utilized to determine spark ignition.

Issued U.S. Pat. No. 4,104,997 illustrates an analog system in which a desired non-linear spark occurrence versus engine speed characteristic is produced by controlling the rates of charging and discharging a capacitor. In the present system the ROM 48 and rate multiplier 53 digitally implement an equivalent function for controlling the rate of pulses produced at the terminal 54, and an accumulator means integrates these pulses to produce the desired result. FIG. 9 illustrates the desired advance angle (spark timing occurrence) versus engine speed characteristic which is desired by issued U.S. Pat. No. 4,104,997 and which is a typical characteristic also desired by the present system. The above referred to copending U.S. application 779,974, now U.S. Pat. No. 4,168,682, explains how the slope changes of the characteristics shown in FIG. 9 can be digitally implemented by use of a rate multiplier and ROM without having the ROM store every individual point of the composite characteristics shown in FIG. 9. It should be noted that in FIG. 9, the curve NV represents the desired spark occurrence characteristic for no vacuum being sensed by an ignition control system whereas the curve V represents the desired characteristic for a predetermined amount of vacuum being sensed by an engine control system.

The present system contemplates providing the read only memory 48 with an additional input signal at an input terminal 55 wherein this additional signal represents the output of a pulse width modulator circuit 56 having its output terminal 57 directly connected to the terminal 55. The pulse width modulator 56 receives an analog signal at an input terminal 58 wherein the magnitude of this analog signal is related to a predetermined engine condition, in the present case related to the magnitude of sensed engine vacuum pressure. The pulse width modulator 56 will then produce a periodic digital two state signal which has a duty cycle (ratio of one logic state to the other during one cycle period) which is related to the magnitude of this analog signal. By coupling this digital two state signal produced at the terminal 57 as an input to the read only memory, the result is that the control signals at the output terminals 49 through 52 of the ROM are now made a function of this analog signal and effectively the ROM control outputs will be switched between two different sets of outputs, one corresponding to a low digital signal at the terminal 55 and another corresponding to a high logic digital signal at the terminal 55. Since the percentage of time (duty cycle) of the logic states of the signal at the terminal 55 is controlled in response to the magnitude of the analog signal at the terminal 58, this results in having output control signals at the terminals 49 through 52 switched back and forth between two extreme values with the average of these control signals being related to the magnitude of the analog signal at the terminal 58. Since the control signals at the terminals 49 through 52 determine the rate multiplication of the rate multiplier 53, and since the output of the rate multiplier is effectively integrated by a following accumulator means, the effect of applying a pulse width modulation signal as an input at the terminal 55 of the read only memory 48 results in providing a continuous interpolation capability between the two extreme control output produced at the terminals 49 through 52 in response to the terminal 55 having a high or low logic state.

For any one set of speed dependent control inputs received from the terminals 43 through 47 of the main counter 41, the ROM 48 need only store a maximum and minimum output corresponding to whether the signal at the terminal 55 is either high or low. In the present case these maximum and minimum outputs correspond to the sensed vacuum pressure being above or below a predetermined vacuum pressure. The actual outputs produced at the terminals 49 through 52 are then made to represent a value more directly indicative of the magnitude of the analog voltage at the terminal 58 by first producing a digital two stage signal whose duty cycle varies in accordance with the analog signal magnitude and then by applying this signal to the input terminal 55.

The improved result obtained by the present system should be contrasted with the prior art technique of providing a different digital output signal for each analog magnitude increment for which resolution of the output signal is desired. In other words, previously if you wanted a read only memory to produce different output signals in response to three different magnitudes (for example) of an analog input signal, then three memory storage spaces within the read only memory would be required wherein three different memory address inputs would address any one of the three different desired outputs. In the present system only two input addresses and two desired outputs are required, and by pulse width modulating a digital signal so that its duty cycle is related to an analog signal magnitude, the read only memory output will be switched back and forth between these two extreme outputs such that the average output of the read only memory will represent any output value in between these two extreme outputs which are stored in the read only memory. Thus the read only memory of the present system need only store two output limits in response to any desired engine condition and an average ROM output corresponding to any magnitude between these two output limits can be obtained merely by using a duty cycle pulse width modulated input signal to the read only memory. This permits saving an enormous amount of read only memory storage space while still enabling the output of the read only memory to have a high resolution correspondence with respect to the magnitude of the input signal. To obtain an equivalent resolution by any of the prior art references could not be digitally accomplished unless an extremely large read only memory capacity was utilized. The present system minimizes the read only memory capacity and therefore implements this function with a substantial cost savings.

The operation of the pulse width modulator and the accumulator means which follows the rate multiplier 53 will now be described in detail. The combination of these elements are claimed in copending U.S. patent application, Ser. No. 049,016, filed June 15, 1979, entitled "Spark and Dwell Ignition Control System Using Digital Circuitry" by Robert S. Wrathall.

The present system contemplates an engine vacuum pressure sensor 59 supplying an analog signal to the input terminal 58 of the pulse width modulator 56. The analog signal magnitude is representative of the state of engine vacuum pressure. Terminals 42 through 44 of the main counter 41 are also received by the pulse width modulator 56 which produces an output at terminal 57.

FIG. 3 illustrates typical embodiments for the vacuum sensor 59 and the pulse width modulator 56 both shown dashed in FIG. 3. The vacuum sensor 59 is contemplated as comprising a two position vacuum sensing switch 60 with a wiper arm terminal coupled to ground and the wiper varying between a first terminal 61 when sensed engine vacuum pressure is below a predetermined threshold value and a second terminal 62 when the sensed vacuum pressure is above this predetermined value. The terminal 62 is coupled to a B+ terminal through a resistor 63 and is coupled to the terminal 58 through a resistor 64. A capacitor 65 is coupled from the terminal 58 to ground. In response to sensing an engine vacuum pressure change from below to above the predetermined threshold, the switch 60 will short the terminal 62 to ground resulting in slowly changing the voltage at the terminal 58 from a high voltage to a low voltage. Preferably this voltage change occurs at a relatively slow 0.5 second time constant. Thus the signal at the terminal 58 represents an analog signal which has a magnitude related to the sensed engine vacuum pressure.

While in the present embodiment an analog signal which varies between two voltage magnitudes which directly correspond to two discrete states of vacuum pressure is illustrated, the present system certainly contemplates other embodiments which provide an analog signal at the terminal 58 which is continuously and directly related to the instantaneous value of engine vacuum presure rather than the opening or closing of a two position engine vacuum sensor switch.

The pulse width modulator circuit 56 comprises a DC level comparator 66 having a negative input terminal coupled to the input terminal 58 through a resistor 67. Limiting diodes 68 and 69 are also connected to the negative input terminal of the comparator 66 and essentially limit the signals received by the comparator to magnitudes either one diode drop above B+ or one diode below ground. The terminals 42 through 44 are received as inputs to a NAND gate 70 whose output is coupled through an inverter 71 to a control terminal 76 of an FET gate 72. An output terminal of the gate 72 is coupled to a positive input terminal 75 of the comparator 66 which is also coupled to B+ through a resistor 73 and to ground through a capacitor 74. The output of the comparator 66 is directly coupled to the output terminal 57 of the pulse width modulator 56.

Essentially the signals at the terminals 42 through 44 are converted by the NAND gate 70 into a relatively slow periodically occurring pulse signal which is used as the control signal for the FET gate 72. This control signal is illustrated in FIG. 10K. In response to each periodic pulse produced at the control gate of the FET 72, the positive input terminal (terminal 75) of the comparator 66 is shorted to a positive reference voltage just above ground potential by the gate 72. After setting the terminal 75 to just above ground, the FET gate 72 is open circuited until the next occurrence of a control pulse at its control terminal 76. FIG. 10K illustrates the control signals at the terminal 76 and FIG. 10L illustrates the signal waveforms produced in response thereto at the positive input terminal 75 of the comparator 66. Superimposed on the waveform shown in FIG. 10L is a high fast dashed voltage level 77 corresponding to low vacuum pressure is being sensed by the sensor 59, a low second voltage level 78 corresponding to the low voltage eventually produced at the terminal 58 upon closure of the switch 60 in response to a high vacuum pressure being sensed, and an interim voltage level 79 corresponding to the voltage at the terminal 58 which would occur at some time after the closure of the switch 60 but before the attainment of the limit level 78. It should be noted that the waveforms in FIGS. 10K and 10L are all commenced at the times $t_1$, and that the horizontal time axes in FIGS. 10K through 10O are shown with greatly expanded time scales as compared with the other graphs in FIGS. 10A–10Q. The time scales for graphs 10K–10M are identical, but the time scales for graphs 10N and 10O are even more expanded.

FIG. 10M shows the output signal of the comparator 66 produced in response to the signal shown in FIG. 10L being created at the positive input terminal 75 while the negative terminal of the comparator 66 receives a transitional voltage corresponding to the dashed level 79 shown in FIG. 10L. FIG. 10M illustrates that the output of the comparator 66 is a digital two state logic signal in which the duty cycle of this signal varies in accordance with the magnitude of the analog signal produced at the terminal 58. For a no vacuum condition corresponding to the level 77 present at the negative input terminal of the comparator 66, the output of the comparator 66 would remain at zero, and for a voltage at the negative input terminal corresponding to the level 78, the output of the comparator 66 would always be high.

FIG. 10M illustrates that for interim values of vacuum (in the case of a continuous analog sensor being used instead of a two position vacuum sensing switch) or in the case of a slowly changing signal representing changing from vacuum to non-vacuum and back again (when a two position vacuum sensing switch is used), an analog signal is produced at the terminal 58 which results in a varying duty cycle signal being produced as the output of the comparator 66. As was previously discussed, applying this varying duty cycle signal to the input of the ROM 48 allows the output of the ROM to vary, in a periodic stepwise manner, between two maximum limits and this produces an output whose average value will be directly related to the magnitude of the analog signal at the terminal 58.

In the present situation, it was found that rapidly switching from a vacuum spark advance determination to a no vacuum spark determination would disrupt the operation of the ignition control system 10. Thus it is necessary to slowly implement the change between vacuum and non-vacuum spark calculations by the system 10. In order to accomplish this, the output of the ROM 48 must be able to represent interim output values between the vacuum and no vacuum conditions corresponding to the levels 78 and 77, respectively. The present system accomplishes this desired result without any increase in the storage space required by the ROM 48.

As was previously mentioned, an accumulator means essentially follows the rate multiplier 53 and effectively converts the pulse count at the terminal 54 into an integrated or accumulated maximum count. It is this accumulation step that results in effectively averaging the different control signal outputs produced at the ROM output terminals 49 and 52 by use of the pulse width modulator 56 altering the duty cycle of the input ROM control signal at the terminal 55.

Before describing the accumulator means coupled to the rate multiplier output terminal 54, a better understanding of the present invention will be obtained by referring to FIGS. 10N and 10O. FIG. 10N represents the incremental count, incrementing at twice the frequency of the clock pulse signal C1, commenced at the times $t_1D$ by the main up-counter 41 on the control terminals 43 through 47 coupled to the ROM 48. After the main counter 41 receives two C1 pulses the count of the main counter, as recorded on the output terminals 43 through 47, is incremented one count. In FIG. 10N the horizontal axis represents an expanded time scale whereas the vertical axis represents the stepped count stored by the terminals 43 through 47. FIG. 10O represents maximum and minimum rates of increase $SL_1$ and $SL_2$ determined by the output terminals 49 through 52 of the read only memory 48. At a subsequent time $t_I$, the count of the main counter is incremented by counting C1 pulses such that terminal 43 now indicates a new count as an input signal to the read only memory 48. Thus a different input control signal is now received by the read only memory 48 and the output terminals 49 through 52 of the ROM now are able to implement different rates of increase $SL_3$ and $SL_4$. The rates of increase $SL_1$–$S_4$ represent different fixed integers used by the rate multiplier for frequency division.

For each different count increment on lines 43–47 the ROM 48 can select either of two different rates of increase for the count processed by the rate multiplier 53 because for any main count received as an input by the ROM 48 from the counter 41, either a zero or one logic state can be produced by the pulse width modulator 56 at the input terminal 55. FIG. 10O illustrates the different characteristics for rates of pulse count increase at terminal 54 that can be implemented by the rate multiplier 53 in accordance with the control input signals received by the read only memory 48 which supplies control inputs to the rate multiplier. By applying a pulse width modulation signal to the input terminal 55, the present system contemplates selectively switching between maximum rates of increase such as $SL_1$ and $SL_3$ and minimum rates of increase such as $SL_2$ and $SL_4$ during the times $t_{1D}$–$t_I$ and after $t_I$, respectively, to obtain a composite (average) rate of increase which can be anywhere within the limits defined by the maximum and minimum rates of increase.

The previously referred to copending U.S. patent application Ser. No. 779,974, filed Mar. 22, 1977, now U.S. Pat. No. 4,168,682, points out how controlling ROM and rate multiplier in accordance with pulse counts related to engine speed can result in determining break points for the composite spark timing advance versus engine speed characteristics illustrated in FIG. 9. Issued U.S. Pat. No. 4,104,997 demonstrates how controlling the rate of increase of an effective integrater means can be utilized to accurately determine desired spark timing relationships as a function of engine speed. The present system combines these two techniques along with providing for pulse width modulation of an input to a read only memory in accordance with sensed engine vacuum pressure in order to minimize the ROM storage space required by an ignition spark timing control system responsive to engine speed and engine vacuum pressure.

From FIGS. 10N and 10O, which are drawn with identical horizontal time scales, it would appear that for optimum interpolation between the maximum and minimum slopes, such as $SL_1$ and $SL_2$, a pulse width modulation frequency for the signal shown in FIG. 10M as high as possible should be selected. In the preferred embodiment, this is not the case since the period of the signal in FIG. 10M is equivalent to eight main counter increments (at the frequency of C1) while the period of the signal in FIG. 10N is equivalent to two main counter increments. This relationship was decided upon in order to permit the rate multiplier to pass enough of the divided down C2 pulses to the output terminal 54 to obtain an adequate number of pulse counts at terminal 54 which represents any of the rates $SL_1$–$SL_4$.

The structure of the effective pulse count accumulator means connected to the output terminal 54 of the rate multiplier 53 will now be described.

The output of the rate multiplier 53 at the output terminal 54 is effectively coupled to an accumulator means which accumulates a count related to the total pulse count produced at the output terminal 54. This accumulator means essentially comprises a select decoder 80, a main advance up-down counter 81 and an auxiliary advance up counter 82. The rate multiplier output terminal 54 is coupled as an input to both the select decoder 80 and a count terminal (>) of the auxiliary advance up counter 82. The auxiliary advance up counter 82 receives a reset signal by means of a direct connection to the terminal 34 at which the $S_1$ pulses are produced. The up counter 82 is a four bit binary counter and produces count outputs at terminals 83 through 86 which are coupled as inputs to preset terminals $P_1$ through $P_4$ of the main advance up-down counter 81. The select decoder 80 receives three inputs in addition to the input from the rate multiplier output terminal 54 and produces a main output at a pulse terminal 87 and a latched advance output signal $S_1L$ at a terminal 88. The select decoder 80 receives the delayed advance pulses $S_1D$ by means of a direct connection to the terminal 40, and the decoder also receives the pulses $C_3$ from a direct input connection to the terminal 30. In addition, the select decoder 80 also receives an input signal termed SSp from a spark logic circuit 90. The signal SSp is a signal produced by the spark logic circuit 90 at the desired time occurrence $t_x$ of spark ignition and this signal is very short in duration (one period of the high frequency clock pulse signal $C_p$). The manner in which the spark logic circuit 90 creates the signal SSp will be subsequently discussed. For the time being it is sufficient to note that this signal occurs at times $t_x$ which represents the time at which spark ignition will occur according to the ignition control system 10.

It should be noted that at the output terminal 88 of the select decoder 80 the latched output signal $S_1L$ produced at this terminal is initiated in response to the delayed advance signal $S_1D$ and is terminated at the time $t_x$. The output produced by the select decoder 80 at the main output terminal 87 essentially comprises the pulse signal $C_3$ during the pulses $S_1D$ (occurring at the times $t_1D$) until the time $t_x$ at which spark ignition occurs. After the times $t_x$ until times $t_{1D}$ the decoder 80 directly couples pulses at the rate multiplier output terminal 54 to the main terminal 87.

The terminal 88 of the select decoder 80 is directly coupled as an input to an up-down control terminal (U/D) of the main up-down advance counter 81. The terminal 87 of the select decoder is directly coupled to an input clock terminal (>) of the advance counter 81. A preset enable (PE) input terminal of the advance counter 81 directly receives the signal SSp by means of a direct connection to the output terminal 89 of the spark logic circuit 90.

An input reset terminal of the advance counter 81 receives a power on reset signal POR by means of a direct connection to a terminal 91. This power on reset signal is merely utilized to initiate operation of the ignition control system 10 in response to the initial application of power to the ignition control system. This is accomplished by means of a capacitor 92 coupled between the terminal 91 and a power on reset terminal 93 that receives positive power when power is applied to the ignition system control 10. The terminal 91 is coupled to ground through a resistor 94. Thus the components 91 through 94 provide for a positive impulse at terminal 91 upon the first application of power to the power on reset terminal 93, and this is utilized to initiate the resetting of the advance counter 81. The advance counter 81 produces an output at a zero detect terminal 94 and this output is produced whenever the advance counter counts down to or through a count of zero.

Essentially, the auxiliary advance counter 82 is reset at the times $t_1$ by the $S_1$ pulses. The counter 82 then proceeds to count up in accordance with the pulses passed by the rate multiplier 53 and provided at the output terminal 54. This count is registered in the four bit binary output terminals 83 through 86. At the time $t_x$ the signal SSp produces a positive spike at the preset enable terminal of the main advance counter 81. This results in instantaneously transferring the count at the output terminals 83 through 86 of the auxiliary advance counter 82 into the main advance counter 81 at the times $t_x$. At this same time the latch signal at the terminal 88 ($S_1L$) is terminated resulting in the up-down control terminal of the advance counter 81 receiving a control input which tells it to count up any subsequently received clock pulses at its clock input terminal. At the times $t_x$, the select decoder 80 now channels the pulses produced at the output terminal 54 of the rate multiplier through the select decoder 80 and its output terminal 87 into the input clock terminal of the advance counter 81. The result of this is that the advance counter 81, after the time $t_x$, essentially acts as if it had continuously counted all of the pulses produced at the terminal 54 since the initial time $t_1$. The reason that the counter 81 did not directly count all of the clock pulses at the terminal 54 from the time $t_1$ to the time $t_x$ was because the counter was engaged in a down counting operation at that time which determines the occurrence of spark ignition. This will now be explained in detail.

From the time $t_x$ until the next time $t_1$, the advance counter 81 continues to count up all of the pulses produced at the output terminal 54 of the rate multiplier 53. Thus at the next time $t_1$ a maximum count is obtained by the main advance counter 81 which is related to the actual time difference between the periodic occurrence of synchronized advance sensor pulses $S_1$ at the times $t_1$. This means that the maximum count obtained by the counter 81 is related to engine speed and that the ROM 48 and rate multiplier 53 control this relationship in a piecewise linear manner to obtain the correct non-linear relationship between the maximum count in the advance counter 81 and engine speed, as well as the relationship between the maximum count and the sensed engine vacuum pressure.

At the time occurrences $t_1D$, which occur just after each of the synchronized advance pulses $S_1$, the select decoder 80 produces a latched signal $S_1L$ at the terminal 88 which now instructs the advance counter 81 to count down instead of up. Simultaneously, the select decoder 80 now channels the fixed frequency clock pulses $C_3$ to its output terminal 87. The end result is that the main advance counter 81 will now count down at a fixed rate determined by the occurrence of the pulses $C_3$ until a zero count is obtained and a zero detect signal is produced at the terminal 94. At this time, this zero detect signal will be received by the spark logic circuit 90 and result in producing the spark occurrence signal SSp which will terminate further down counting, load the count of the auxiliary advance counter 82 into the main counter 81 and initiate the main counter 81 up counting the pulses produced at the terminal 54.

The operation of the components 80 through 82 is probably best understood by referring to FIGS. 10I and 10J. FIG. 10I represents the accumulated count in the auxiliary advance counter 82. This count is essentially the non-linear pulse occurrences which occur at the output terminal 54 of the rate multiplier 53. At the times $t_x$ at which the pulses SSp occur, the count of this counter is directly transferred to the advance counter 81 by means of preset enable circuitry. Preset enable circuitry for counters is very well known and merely results in loading a counter with a preset counter in response to an actuation pulse being received at a preset enable terminal.

FIG. 10J illustrates the count in the main advance counter 81. This figure illustrates that at the times $t_1$ a maximum count is obtained by the advance counter 81. Then at times $t_1D$ the counter 81 will count down at the fixed rate determined by the rate occurrence of the signal $C_3$, whereas the up counting of this counter was determined by the ROM 48 and rate multiplier 53 implementing a stepwise rate of increase of pulse counts. U.S. Pat. No. 4,104,997 clearly illustrates how such a stepwise increasing rate combined with a linear decreasing rate will result in accurately determining the spark time occurrence for internal combustion engines so that a proper advance versus engine speed relationship is developed. Since the equations demonstrating this relationship are contained in the referred to issued U.S. patent, they will not be repeated here.

From the foregoing statements it should be evident that the decoder 80 and counters 81 and 82 effectively form an accumulating means for the pulses produced at the output terminal 54 of the rate multiplier 53. At the times $t_{1D}$, this accumulated count is then linearly decreased at a fixed rate determined by the time occurrence of the pulses $C_3$ until a zero detect signal is produced at the terminal 94. This zero detect signal represents the desired spark timing occurrence, and the spark logic circuit 90 utilizes this signal to produce the signal SSp at the terminal 89 as well as produce a composite signal (dwell/spark) at an output terminal 100 which contains both dwell and spark timing information. This composite signal at the terminal 100 is then coupled to an input terminal 101 of an output pre-driver 99 which supplies an output at a terminal 102 to a final driver stage 103, in an ignition coil power stage 98 (shown dashed), that controls the excitation of the primary winding 104 of an ignition coil. A high voltage secondary winding 105 of the ignition coil is coupled to the spark gaps of a two cylinder engine to produce ignition pulses therein.

A primary ignition coil current sensing resistor 106 is contemplated as sensing the current through the primary coil 104 and providing a feedback signal at a terminal 107 which is coupled as an input to the output pre-driver. This is utilized to maintain constant primary ignition coil current excitation in a well known manner. The output pre-driver 99 also receives an input at a terminal 109 related to actual battery voltage magnitude and another input at a terminal 110 related to whether or not an engine stall condition has occurred. If engine stall, abrupt slow crankshaft rotation, has been detected, then the current through the primary coil 104 will be slowly decreased so as to remove energization from this coil without generating a spark until the engine stall condition has been rectified. The battery voltage magnitude signal at the terminal 109 is utilized to alter the ignition coil current driving signal to obtain constant energy spark ignition despite variations in battery voltage. The output pre-driver 99 and the ignition coil power stage 98 are contemplated as comprising standard electronic ignition system components and therefore the details of these components will not be discussed since they do not form part of the present invention.

The spark logic circuit 90 which creates the dwell/spark control signal at terminal 100 receives the master clock pulses $C_p$ from a direct connection to the terminal 26. The circuit 90 also is directly connected to the terminals 34 and 38 for receiving the signals $S_1$ and $S_2$, respectively. The spark logic circuit 90 receives the POR signal at a reset terminal for initiating the logic components contained in the circuit 90 in response to the initial application of power to the electronic ignition control system 10. The circuit 90 also receives the zero detect signal produced at the terminal 94 of the main advance counter 81. In addition, the spark logic 90 also receives a dwell initiation signal by means of a direct connection to an output terminal 120 of a dwell circuit 121, and the circuit 90 also receives a slow speed detect signal from an output terminal 122 of a slow speed decoder 123. In response to all of these inputs the spark logic circuit 90 produces the signal SSp at the terminal 89 wherein the SSp signal is a pulse at $t_x$ which exists for one clock pulse period of the pulses $C_p$. The circuit 90 will also create a combined dwell initiate and spark timing occurrence output signal at the output terminal 100.

Essentially, once the spark logic circuit 90 has been reset by the application of power to the electronic ignition control system 10 by the POR signal, the logic circuit 90 will receive dwell initiate signals from the terminal 120 and spark timing occurrence signals from the terminal 94 for each cycle of cylinder compression. If for some reason a dwell initiating signal has not been received by the spark logic circuit 90 prior to the occurrence of the pulse $S_1$ which is generated at the maximum possible advance point of crankshaft rotation, then the spark logic circuit 90 will initiate dwell at the times $t_1$ corresponding to the occurrence of the pulses $S_1$. Similarly, if for some reason a spark ignition has not occurred by the times $t_2$ at which the pulses $S_2$ occur, then the spark logic 90 will create a spark occurrence at these times. Actually, when the slow speed decoder 23 determines that engine rotating speed is below a predetermined minimum level, the signal at the terminal 122 insures that dwell will be initiated at the times $t_1$ and that spark will occur at the times $t_2$. This provides a dwell equal to 35 degrees of crankshaft rotation for slow speed conditions and provides for spark ignition at essentially top dead center of the cylinder compression cycle. For engine speeds above this predetermined slow speed, the signal at the terminal 122 allows dwell to be initiated by the signal at the terminal 120 and spark to be determined by the zero detect provided at the terminal 94. The signal produced at the terminal 100 is initiated in response to when dwell is desired to commence ($t_{DW}$) and is terminated in response to when the spark logic 90 determines spark ignition should occur ($t_x$).

A typical embodiment for the spark logic circuit 90 is illustrated in FIG. 7. The power on reset connection has not been shown in FIG. 7 in order to simplify the diagram. All of the components in FIG. 7 correspond to standard logic gate components and flip flop devices.

The engine stall indicating signal produced at the terminal 110 is the output of an engine stall counter 125 which receives a reset input signal by a direct connection to the terminal 34. The counter 125 receives a counting clock input signal by means of an input direct connection to the terminal 47 of the main up counter 41. In this manner, if the stall counter 125 determines that between consecutive times $t_1$ at which the synchronized advance pulses $S_1$ occur, the main up counter 41 has registered a predetermined number of changes in the most significant bit of the counter which is connected to the terminal 47, then the counter 125 will indicate that the count being registered by the main up counter 41 is too high. This indicates that the actual time elapsed between consecutive times $t_1$ is too great thus indicating that the engine has stalled by virtue of the fact that the engine crankshaft is not rotating above a predetermined speed. When this is determined, a stall indicating signal at the terminal 110 will be received by the output pre-driver 99 and result in appropriately modifying the output of the pre-driver to take into account this condition. The internal construction of the stall counter 125 merely consists of a resettable pulse counter which develops an output whenever the pulse count is above a predetermined threshold. Readily available logic circuits can implement such a function.

The slow speed decoder 123 essentially works on a similar principle to the stall counter 125. The slow speed decoder 123 determines when the count in the main up counter 41 exceeds a predetermined maximum count. This accomplished by coupling the terminals 43 through 47 as inputs to the slow speed decoder 123. The decoder 123 is reset at times $t_1D$ via a connection to terminal 40. The decoder also receives the pulses $S_1$ via a direct connection to the terminal 34 and it receives a power on reset pulse via a direct connection to the terminal 91. In response to all of these inputs the decoder 123 produces a slow speed detection at the terminal 122 at times $t_1$ whenever the count of the main counter indicates that the actual time between the $S_1D$ pulses exceeds a predetermined maximum time. Whenever this occurs, this indicates that the engine speed is below a predetermined minimum speed, and the signal at the terminal 122 is received by the spark logic circuit 90 and results in initiating dwell at the times $t_1$ and causing spark ignition to occur at the times $t_2$. Of course the engine speed which actuates the stall counter 125 is an engine speed which is much less than the predetermined engine speed which resulted in actuating the slow speed decoder 123. FIG. 6 illustrates a typical embodiment for the slow speed decoder 123 and the components in FIG. 6 represent standard logic circuit components used for a typical implementation.

It should be noted that FIG. 5 illustrates a typical digital circuit implementation for the select decoder 80. In FIG. 5 controllable gates 126 and 127 are illustrated. These gates operate as selective open or short circuits between there throughput terminals in response to the digital logic signals present at their respective control terminals 128 and 129.

It should also be noted that FIG. 4 illustrates a typical digital circuit implementation for the advance and reference buffers 21 and 22, the pulse synchronizers 33 and 37, the delay circuit 39 and the inhibit circuit 36. Again it should be noted that the logic circuit implementations shown in FIG. 4 comprise standard digital logic circuits.

The inhibit circuit 36, besides producing a four millisecond delay pulse at the terminal 35 in response to receiving a spark ignition signal (SSP) and in response to the received C1 pulses provided as a timing duration input, also provides a two millisecond delay signal after spark ignition at an output terminal 130. The terminal 130 is coupled to the dwell circuit 121 and the two millisecond signal serves to inhibit the operation of the dwell circuit until at least two milliseconds after the occurrence of spark ignition. This is required in order to prevent 100 percent dwell from occurring at very high engine speeds. If 100 percent dwell were to occur then no spark ignition would be permitted since current excitation for the ignition coil primary winding 104 would always be applied.

Essentially the inhibit circuit 36 merely utilizes the signal (SSp) at the times $t_x$ to initiate two different monostable time periods which are provided at the terminals 35 and 130 to implement different delays for circuitry in the electronic spark ignition control system 10. The detailed configuration of the inhibit circuit 36 will not be specifically recited since the embodiment in FIG. 5 is a typical embodiment using standard components and many other embodiments could accomplish this desired function.

Typical embodiments for the dwell circuit 121 of the present invention will now be discussed. A first such typical embodiment 121 is illustrated in FIG. 2, and another embodiment 121' is illustrated in FIG. 8 which was subsequently developed by a co-worker of the present inventor and is claimed in copending U.S. patent application Ser. No. 049,014 filed June 15, 1979 entitled "Improved Digital Dwell Circuit" by Adelore Petrie. In FIG. 8 prime notation is utilized to identify substantially similar corresponding components.

In both of the dwell embodiments shown in FIGS. 2 and 8, the dwell circuit 121 (121') receives running count counter inputs from the main counter output terminals 42 through 47 at preset input terminals $P_1$ through $P_6$ of a dwell down counter 131 (131'). The terminal 34 at which the $S_1$ pulses are produced is directly coupled to a preset enable terminal of the dwell down counter and a counting clock pulse input terminal 132 (132') for the dwell down counter is provided.

For the dwell circuit embodiment illustrated in FIG. 2, the terminal 31 at which the pulses $C_4$ are produced is coupled through a controllable gate 133 to the terminal 132. The terminal 132 is also coupled as a pulse counter input to an auxiliary dwell counter 134 which has a reset terminal directly coupled to the terminal 40 for receiving reset pulses at the times $t_1D$ corresponding to the pulses $S_1D$. The count output of the auxiliary dwell counter 134 is coupled to a maximum count logic circuit 135 which is intended to produce a low output signal at its output terminal 136 in response to the count in the auxiliary dwell counter reaching or exceeding a predetermined maximum count. The terminal 136 is directly connected to a control terminal 137 of the through gate 133. In this manner, the auxiliary dwell counter 134 insures that after the reception of reset pulses $S_1D$, the through gate 133 will pass a precise number of clock pulses as inputs to the input terminal 132 of the dwell down counter 131 and auxiliary counter 134.

At the times $t_1$, the count of the dwell counter 131 is preset to the maximum running count obtained by the main counter 41, wherein this maximum count is directly linearly related to engine crankshaft speed. The auxiliary dwell counter 134 and controllable gate 133 effectively result in, subsequently at times $t_1D$, having the dwell down counter 131 rapidly count down a predetermined number of counts from the maximum speed related count obtained by the main counter 41. It should be noted that the rate of down counting occurs at the relatively high repetition frequency of the signal $C_4$, whereas the rate of up counting the main counter 41 occurs at the substantially slower rate of occurrence of the pulses $C_1$. This results in the dwell down counter 131 effectively instantly subtracting (at times $t_1D$) the predetermined number of $C_4$ pulses passed through the controllable gate 133 from the maximum count which was pre-set into the dwell down counter 131 at the times $t_1$ by the synchronized pulses $S_1$.

For the dwell circuit in FIG. 2, the terminals 42 through 47 of the main up counter 41 are also coupled as inputs to a count comparator 138 which also receives the output count of the dwell down counter 131. When the count indicated by the terminals 42 through 47 equals or exceeds the count being held (after down counting has ceased) as the output count of the dwell down counter 131, the comparator 138 will produce a logic signal indicating this condition at an output terminal 139. The terminal 139 is coupled to an input set terminal 140 of a latch device 141. The output of the latch device 141 is coupled through a controllable gate 144 to the output terminal 120 of the dwell circuit 121 and a reset terminal 142 of the latch 141 is directly coupled to the terminal 34 at which the $S_1$ signal is produced. The two millisecond inhibit signal produced at the terminal 130 is coupled to a control terminal 143 of the controllable gate 144.

The dwell circuit shown in FIG. 2 operates as follows. At the time occurrence $t_1$ of the synchronized advance pulses $S_1$, the maximum running count in the main counter 41 is preset into the dwell down counter 131. At times $t_1D$ after the maximum count of the main counter 41 is loaded into the dwell down counter 131, the circuitry 132 through 137 has the down counter 131 rapidly count down a predetermined number of counts. Preferably this predetermined number of counts which occur at the high fixed frequency of the pulses $C_4$ will be equivalent to 6 milliseconds of real time as measured by an equivalent number of pulse counts at the frequency of the signal pulses $C_1$.

At the times $t_1D$ after the pre-setting of the dwell down counter 131, the main up counter 41 is reset by the pulses $S_1D$. At approximately this time the dwell down counter 131 will have completed its effective subtraction of a predetermined number of counts from the maximum count preset into the dwell down counter 131. Thus the comparator 138, just after the times $t_1D$, will compare the subtracted output count of the dwell down counter 131 with the newly initiated running count of the main up counter 41. Whenever the main up counter running count reaches or exceeds the held subtracted down count of the dwell counter 131, the comparator 138 will produce a high logic state at its output terminal 139 which will result in setting the latch 141 whose output at the terminal 120 signals the desired initiation of coil excitation (dwell). This mode of operation is essentially illustrated in FIG. 10P wherein the vertical axis represents the count being stored in a counter and the horizontal axis represents time.

Essentially between first and second time occurrences $t_1D$ and $t_1$ (which directly correspond to identical polarity periodic signal pulse transitions of the variable rate occurrence signal $S_1$), the main counter 41 produces a running count by counting the pulses $C_1$ which have an engine speed independent repetition rate. At times $t_1$ a maximum running count related to engine crankshaft rotational speed is loaded into the down counter 131. The down counter then effectively subtracts a predetermined number of $C_4$ pulse counts to arrive at a resultant subtracted count at substantially the time occurrence $t_1$. This resultant subtracted count is then utilized to produce dwell ignition occurrences, preferably at a substantially fixed time duration prior to the next time occurrence of $t_1$ which corresponds to the next pulse transition of the periodic signal $S_1$.

It should be noted that while the present invention contemplates utilizing the crankshaft position sensor signal $S_1$ as the periodic signal having periodic signal pulse transitions occurring at a predetermined variable (speed dependent) rate, the present invention also contemplates the use of the spark occurrence signal SSp as the periodic signal having pulse transitions which occur at a variable (speed dependent) rate. In this manner the present invention can implement dwell at a predetermined time prior to spark ignition occurrence rather than at a predetermined time prior to the occurrence of a specific engine crankshaft position. In order to implement such a change only minor modifications of the disclosed circuitry are necessary and these modifications are within the capability of those of average skill in the art.

In FIG. 10P, the count of the dwell counter 131 is illustrated as a solid line whereas the count of the main up counter 41 is illustrated as a dashed line. FIG. 10P illustrates at the times $t_1$ a maximum count is preset into the dwell down counter 131 and then a predetermined number of counts is rapidly subtracted (at times $t_1D$) from this number. Subsequently the dwell counter 131 maintains this subtracted count as its output. At the times $t_1D$, the count in the main counter 41 is set to zero and this counter will commence up counting in response to the pulses $C_1$ resulting in linear incrementing of the count of the counter 41. At a subsequent time $t_{DW}$ the count in the main counter 41 will equal the subtracted count being maintained by the dwell counter 131. At this time $t_{DW}$ the comparator 138 will produce a logic signal that will set the latch 141 and thereby signal the initiation of dwell by the signal produced at the latch output terminal 120. The latch 141 will be reset upon the occurrence of the pulse signal $S_1$.

The present invention, by utilizing substantially all of the time duration between identical polarity pulse transitions of the crankshaft position sensor signal $S_1$ to determine the maximum running count which is related to engine speed, has provided a maximum running count which is an extremely accurate indication of engine speed. Since this running count is updated for each engine crankshaft rotation of 360 degrees, the engine speed information is similarly updated for each crankshaft revolution thus providing an up to date indication of engine speed. By providing a maximum running count related to engine speed during one full cycle (between identical polarity transitions) of crankshaft revolution and utilizing this maximum running count to determine dwell initiation during the subsequent cycle of crankshaft revolution, the present invention is capable of producing large dwell angles which is something that has not been obtained by similar prior art circuits (U.S. Pat. No. 3,908,616) which illustrate utilizing a first portion of the crankshaft revolution cycle to calculate engine speed and a second portion of the same crankshaft revolution cycle to calculate dwell occurrence. Thus the prior art circuits limit dwell occurrence to this second portion of the crankshaft revolution cycle.

In addition to permiting the dwell circuit to implement large angles of dwell excitation, the present invention implements dwell without adjusting count threshold levels of count comparators and without adjusting the various rates of count accumulating. While adjusting the rate of count accumulating was found to be necessary for the spark control circuitry disclosed herein, it is obvious that the rate adjustment circuitry is much more complex and costly than the dwell control circuitry. Thus the present invention is believed to be superior to prior dwell control circuits which require adjusting pulse accumulation rates or pulse count switching threshold levels in order to implement a desired dwell excitation mode over a range of different engine speeds.

The controllable gate 144 is utilized to insure that the dwell initiation signal at terminal 120 will not start until at least 2 milliseconds after the occurrence of spark ignition. This insures that 100 precent dwell will not be obtained, and that therefore the primary ignition coil winding 104 will not be constantly excited. This insures the occurrence of a spark for each cylinder when it is in its compression cycle, since if the primary winding always received current excitation no spark could be generated.

FIG. 8 illustrates another embodiment 121' of the dwell circuit which is similar to the embodiment shown in FIG. 2. Identical reference numbers are utilized for identical components and prime notation is used for similar components.

In FIG. 8, output count terminals 42 through 47 of the main counter 41 are connected to preset inputs $P_1$ through $P_6$ of a dwell down counter 131'. A preset enable terminal of the dwell counter 131' is directly coupled to the terminal 34 such that the counter will be preset in response to the pulses $S_1$. In FIG. 8, a dwell counter overflow terminal is directly connected to a terminal 139' which is coupled to a terminal 140' that is directly connected to the set terminal of a latch 141' having its output connected to the terminal 120 through a controllable gate 144'. A reset terminal of the latch 141' is directly connected to the terminal 34 thus providing for resetting the latch 141' in response to the signal $S_1$. The controllable gate 144' has a control terminal 143' which is directly connected to the terminal 130 such that the controllable gate 144' will implement a minimum 2 millisecond delay after SSp for initiating a dwell signal at terminal 120.

The dwell down counter 131' has a clock input terminal 132' which is coupled through a controllable gate 133' and an OR gate 160' to the terminal 31 at which the pulses $C_4$ are present. An auxiliary dwell counter 134' has a reset terminal directly connected to the terminal 40 and a clock signal input terminal directly connected to an output terminal 159 of gate 133'. The output count of the auxiliary dwell counter 134' is coupled to a maximum count logic circuit 135' which produces an output signal at a terminal 137' whenever the auxiliary dwell counter count equals or exceeds a predetermined count. The terminal 137' is directly connected as a control input terminal to the controllable gate 133', and this terminal is also coupled through an inverter stage to a control input terminal 150' of a controllable gate 151' coupled, together with OR gate 160', between the terminal 132' and the terminal 28 at which the pulses $C_1$ are present. The OR gate 160' permits pulses passed by either of the controllable gates 133' or 151' to reach the terminal 132'.

The operation of the dwell circuit 121' illustrated in FIG. 8 will now be described with reference to the graph shown in FIG. 10Q which essentially illustrates the operation of the dwell circuit 121' by illustrating the count of the dwell down counter 131' as a function of time. At the times $t_1$, the dwell down counter 131' is preset with the maximum count obtained by the main up counter 41. At the subsequent times $t_1D$, the count of the auxiliary dwell counter 134' is set to zero resulting in the controllable gate 133' passing a predetermined number of the rapidly occurring clock pulses $C_4$. After the auxiliary dwell counter has counted this predetermined number of $C_4$ pulses, the maximum count logic circuit 135' will open the controllable gate 133' and result in closing the controllable gate 151'. During this time, the dwell down counter 131 has effectively, instantaneously subtracted this predetermined number of counts from the maximum count which was preset into the dwell counter 131'. Subsequent to this subtraction, the dwell down counter 131' will continue down counting at a rate determined by the occurrence of the pulses $C_1$. It should be noted that this occurrence rate is the same occurrence rate at which the main counter 41 is being linearly incremented up to its maximum count representative of engine crankshaft speed. At a subsequent time $t_{DW}$ the count in the dwell down counter 131' will reach zero and on the next count an overflow indication will be produced at the terminal 139'. This will result in setting the latch 141 and providing a dwell initiation signal at the output terminal 120 assuming at least a two millisecond delay between spark occurrence and dwell initiation.

The dwell circuit in FIG. 8 differs from that in FIG. 2 in that the need for a complex count comparator such as the comparator 138 in FIG. 2 is eliminated by the circuit configuration shown in FIG. 8. This is accomplished by having the dwell down counter 131' continue to count down at a rate determined by the $C_1$ pulses after effectively subtracting a predetermined number of counts occurring at the rapid frequency of the signal $C_4$. In this manner, the output of the dwell down counter 131' will reach zero at predetermined times $t_{DW}$ ahead of the predetermined times $t_1$. This occurs since if no counts were subtracted and engine speed remained the same, then the dwell down count would overflow exactly at times $t_1$. Thus the dwell circuits 121' and 121 insure that dwell initiation will occur at a predetermined time prior to the occurrence of the advance pulses $S_1$ at the times $t_1$. The circuit 121' in FIG. 8 accomplishes this end result without the use of the complex comparator 138 shown in FIG. 2 and therefore is believed to be more economical since fewer connecting lines and logic gates are required for the circuit 121'.

While I have shown and described several embodiments for the present invention, further inprovements and modifications will occur to those of skill in the art. All such modifications which retain the basic underlying principles disclosed and claimed herein and within the scope of this invention.

I claim:

1. Circuitry for receiving a signal comprising periodic pulse transitions and producing indicative signals commencing at predetermined times prior to the occurrence of the periodic pulse transitions, said circuitry comprising:

means for producing a periodic signal comprising periodic signal pulse transitions occurring at a predetermined variable rate;

means for receiving said periodic signal and for periodically developing a running count by counting pulses occurring at a predetermined rate, independent of said variable rate, between first and second predetermined time occurrences directly corresponding to the occurrence of sequential first and second pulse transitions of said periodic signal, and for providing at said second time occurrences maximum running counts related to the time duration between said first and second pulse transitions;

means for periodically receiving said maximum counts and effectively subtracting a predetermined number of counts therefrom to obtain a resultant subtracted count, said subtraction being completed at substantially said second time occurrences;

means for periodically utilizing said resultant subtracted counts to initiate an indicative signal after said second time occurrence at which said maximum running count was created that resulted in said subtracted resultant count and at a predetermined time prior to the occurrence of the next of said pulse transitions of said periodic signal after said second time occurrence, wherein said utilizing means comprises means for incrementing a count at a rate related to said predetermined rate of said running count after said second time occurrence, and for initiating said indicative signal in response to said incremented count being at least equal to a threshold count, and wherein said subtraction means comprises a down counter which implements a subtraction function by down counting, wherein said subtraction means includes means for loading said maximum running counts into said down counter substantially at said second time occurrences and for subsequently applying, as an input to said down counter, for down counting thereby, a predetermined number of pulses, said resultant subtracted count being equal to said maximum running count less the number of down counted pulses.

2. Circuitry according at claim 1 wherein said predetermined number of counts subtracted from said maximum running counts by said subtraction means is fixed.

3. Dwell circuitry for an ignition control system of an internal combustion engine, said dwell circuitry comprising:

means for periodically developing a running count by counting pulses occurring at a predetermined, speed-independent rate between first and second predetermined time occurrences directly corresponding to periodic signal pulse transitions having occurrences related to predetermined angular positions of rotation of an engine crankshaft, and for providing at said second time occurrences maximum running counts related to the rotational speed of the engine crankshaft;

means for periodically receiving said maximum counts and effectively subtracting a predetermined number of counts therefrom to arrive at a resultant subtracted count said subtraction being completed at substantially said second time occurrences; and means for periodically utilizing said resultant subtracted counts to initiate ignition dwell after said second time occurrence at which said maximum running count was created that resulted in said subtracted resultant count and at a predetermined time prior to the occurrence of the next of said periodic signal pulse transitions after said second time occurrences, wherein said utilizing means comprises means for incrementing a count at a speed-independent rate after said second time occurrence at which said resultant count was created, and initiating dwell in response to said incremented count being at least equal to a threshold count, whereby dwell is substantially initiated at a predetermined time prior to the next occurrence of a maximum running count at said second time occurrences, and wherein said speed-independent predetermined pulse rate for incrementing said running count is fixed, and said subtraction means comprises a down counter which implements said effective subtraction by down counting pulses, wherein said subtraction means includes means for loading said maximum running counts into said down counter substantially at said second time occurrences and for subsequently applying, as an input to said down counter for down counting thereby, a predetermined number of pulses, said resultant subtracted count being equal to said maximum running count less the number of down counted pulses.

4. Dwell circuitry according to claim 3 wherein said means for developing said running counts and said maximum running counts is a pulse counter and wherein at least one of said running counts and said maximum running counts are utilized by spark timing means for determining spark occurrences subsequent to dwell initiation.

5. Dwell circuitry for an ignition control system of an internal combustion engine, said dwell circuitry comprising:

means for periodically developing a running count by counting pulses occurring at a predetermined, speed-independent rate between first and second predetermined time occurrences directly corresponding to periodic signal pulse transitions having occurrences related to predetermined angular positions of rotation of an engine crankshaft, and for providing at said second time occurrences maximum running counts related to the rotational speed of the engine crankshaft;

means for periodically receiving said maximum counts and effectively subtracting a predetermined number of counts therefrom, said subtraction being completed at substantially said second time occurrences, and holding said resultant count after second time occurrences; and means for periodically utilizing said resultant subtracted counts to initiate ignition dwell after said second time occurrence at which said maximum running count was created that resulted in said held resultant count and prior to the occurrence to the next of said periodic signal pulse transitions after said second time occurrences, wherein said utilizing means comprises comparison means coupled to said running count means and said subtraction means for comparing said held resultant count with said running count occurring after said second time occurrences, said comparison means initiating dwell in response to said running count being at least equal to said held resultant count, whereby dwell is substantially initiated at a predetermined time prior to the next occurrence of a maximum running count at said second time occurrences, wherein said speed-independent predetermined pulse rate for incrementing said running count is fixed, wherein said predetermined number of counts subtracted from said maximum running counts by said subtraction means is fixed and wherein said subtraction means comprises a down counter which implements said effective subtraction by down counting pulses, wherein said subtraction means includes means for loading said maximum running counts into said down counter substantially at said second time occurrences and for subsequently applying, as an input to said down counter for down counting thereby, a predetermined number of pulses, said resultant subtracted count being equal to said maximum running count less the number of down counted pulses.

6. Dwell circuitry according to claim 5 wherein said means for developing said running count and maximum running count includes a pulse counter.

7. Dwell circuitry according to claim 6 wherein at least one of said running counts and said maximum running counts developed by said pulse counter are utilized by spark timing means for determining spark occurrences subsequent to dwell initiation.

8. Dwell circuitry for an ignition control system of an internal combustion engine, said dwell circuitry comprising:

means for periodically developing a running count by counting pulses occurring at a predetermined, speed-independent rate between first and second predetermined time occurrences directly corresponding to periodic signal pulse transitions having occurrences related to predetermined angular positions of rotation of an engine crankshaft, and for providing at said second time occurrences maximum running counts related to the rotational speed of the engine crankshaft;

means for periodically receiving said maximum counts and effectively subtracting a predetermined number of counts therefrom to arrive at a resultant subtracted count, said subtraction being completed at substantially said second time occurrences; and means for periodically utilizing said resultant subtracted counts to initiate ignition dwell after said second time occurrence at which said maximum running count was created that resulted in said resultant subtracted count and at a predetermined time prior to the occurrence of the next of said periodic signal pulse transistions after said second time occurrences, said utilizing means comprises means for incrementing a count at a speed-independent rate after said second time occurrence at which said resultant count was created, and initiating dwell in response to said incremented count being at least equal to a threshold count, whereby dwell is substantially initiated at a predetermined time prior to the next occurrence of a maximum running count at said second time occurrences, and wherein said means for developing said running counts and said maximum running counts includes a pulse counter which provides, as its output count, said running counts and said maximum running counts, wherein said pulse counter is coupled to said subtraction means for supplying said maximum running counts, and wherein said pulse counter is also separately coupled to a spark timing calculation means which is separate from said subtraction means, for supplying at least one of said running counts and said maximum running counts of said pulse counter thereto for separate and additional use of said one counts by said spark timing means for calculating, determining, and creating spark occurrences subsequent to dwell initiation.

9. Circuitry for receiving a signal comprising periodic pulse transitions and producing indicative signals commencing at predetermined times prior to the occurrence of the periodic pulse transitions, said circuitry comprising:

means for producing a periodic signal comprising periodic signal pulse transitions occurring at a predetermined variable rate;

means for receiving said periodic signal and for periodically developing a running count by counting pulses occurring at a predetermined rate, independent of said variable rate, between first and second predetermined time occurrences directly corresponding to the occurrence of sequential first and second pulse transitions of said periodic signal, and for providing at said second time occurrences maximum running counts related to the time duration between said first and second pulse transitions;

means for periodically receiving said maximum counts and effectively subtracting a predetermined number of counts therefrom to obtain a resultant subtracted count, said subtraction being completed at substantially said second time occurrences;

means for periodically utilizing said resultant subtracted counts to initiate an indicative signal after said second time occurrence at which said maximum running count was created that resulted in said subtracted resultant count and at a predetermined time prior to the occurrence of the next of said pulse transitions of said periodic signal after said second time occurrence, wherein said utilizing means comprises means for incrementing a count at a rate related to said predetermined rate of said running count after said second time occurrence, and for initiating said indicative signal in response to said incremented count being at least equal to a threshold count, and wherein said subtraction means comprises a down counter which implements a subtraction function by down counting, wherein said subtraction means includes means for loading said maximum running counts into said down counter substantially at said second time occurrences and for subsequently applying, as an input to said down counter for counting down thereby, a predetermined number of pulses having an occurrence rate substantially exceeding said predetermined rate of said running count, whereby said subtraction is implemented substantially at said second time occurrences by having said down counter count a predetermined number of rapidly occurring pulses at said second time occurrences after said maximum running counts had previously been loaded into said down counter.

10. Dwell circuitry for an ignition control system of an internal combustion engine, said dwell circuitry comprising:

means for periodically developing a running count by counting pulses occurring at a predetermined, speed-independent rate between first and second predetermined time occurrences directly corresponding to periodic signal pulse transitions having occurrences related to predetermined angular positions of rotation of an engine crankshaft, and for providing at said second time occurrences maximum running counts related to the rotational speed of the engine crankshaft;

means for periodically receiving said maximum counts and effectively subtracting a predetermined number of counts therefrom to arrive at a resultant subtracted count said subtraction being completed at substantially said second time occurrences; and means for periodically utilizing said resultant subtracted counts to initiate ignition dwell after said second time occurrence at which said maximum running count was created that resulted in said subtracted resultant count and at a predetermined time prior to the occurrence of the next of said periodic pulse transitions after said second time occurrences, wherein said utilizing means comprises means for incrementing a count at a speed-independent rate after said second time occurrence at which said resultant count was created, and initiating dwell in response to said incremented count being at least equal to a threshold count, whereby dwell is substantially initiated at a predetermined time prior to the next occurrence of a maximum running count at said second time occurrences, and wherein said speed-independent predetermined pulse rate for incrementing said running count is fixed, and said subtraction means comprises a down counter which implements said effective subtraction by down counting pulses, wherein said subtraction means includes means for loading said maximum running counts into said down counter substantially at said second time occurrences and for subsequently applying, as an input to said down counter for down counting thereby, a predetermined number of pulses having an occurrence rate substantially exceeding said speed independent rate of said pulses causing the incrementing of said running count.

11. Dwell circuitry for an ignition control system of an internal combustion engine, said dwell circuitry comprising:

means for periodically developing a running count by counting pulses occurring at a predetermined, speed-independent rate between first and second predetermined time occurrences directly corresponding to periodic signal pulse transitions having occurrences related to predetermined angular positions of rotation of an engine crankshaft, and for providing at said second time occurrences maximum running counts related to the rotational speed of the engine crankshaft;

means for periodically receiving said maximum counts and effectively subtracting a predetermined number of counts therefrom, said subtraction being completed at substantially said second time occurrences, and holding said resultant count after second time occurrences; and means for periodically utilizing said resultant subtracted counts to initiate ignition dwell after said second time occurrence at which said maximum running count was created that resulted in said held resultant count and prior to the occurrence of the next of said periodic signal pulse transitions after said second time occurrences, wherein said utilizing means comprises comparison means coupled to said running count means and said subtraction means for comparing said held resultant count with said running count occurring after said second time occurrences, said comparison means initiating dwell in response to said running count being at least equal to said held resultant count, whereby dwell is substantially initiated at a predetermined time prior to the next occurrence of a maximum running count at said second time occurrences, wherein said speed-independent predetermined pulse rate for incrementing said running count is fixed, wherein said predetermined number of counts subtracted from said maximum running counts by said subtraction means is fixed and wherein said subtraction means comprises a down counter which implements said effective subtraction by down counting pulses, wherein said subtraction means includes means for loading said maximum running counts into said down counter substantially at said second time occurrences and for subsequently applying, as an input to said down counter for counting down thereby, a predetermined number of pulses having an occurrence rate substantially exceeding said speed independent rate of said pulses causing the incrementing of said running count.

* * * * *